US005242109A

United States Patent [19]

Esmond

[11] Patent Number: 5,242,109

[45] Date of Patent: * Sep. 7, 1993

[54] METHOD AND APPARATUS FOR DISPELLING FOG

[75] Inventor: Jack B. Esmond, Spring, Tex.

[73] Assignee: Esmond & Clifford, Inc., Houston, Tex.

[ * ] Notice: The portion of the term of this patent subsequent to Jan. 5, 2010 has been disclaimed.

[21] Appl. No.: 840,632

[22] Filed: Feb. 21, 1992

Related U.S. Application Data

[63] Continuation of Ser. No. 508,906, Apr. 12, 1990, abandoned.

[51] Int. Cl.[5] ..... A01G 15/00; E01H 13/00

[52] U.S. Cl. ..... 239/2.1; 239/14.1

[58] Field of Search ..... 239/2.1, 14.1; 55/221, 55/388

[56] References Cited

U.S. PATENT DOCUMENTS

| | | | |
|---|---|---|---|
| 2,934,275 | 4/1960 | Ball . | |
| 2,969,920 | 1/1961 | Giannoni | 239/14.1 |
| 3,274,035 | 9/1966 | Burhardt et al. . | |
| 3,378,201 | 4/1968 | Glew et al. . | |
| 3,434,661 | 3/1969 | Boyle et al. . | |
| 3,608,810 | 9/1971 | Kooser . | |
| 3,608,820 | 9/1971 | Kooser . | |
| 3,722,815 | 3/1973 | Moore | 239/2.1 |
| 3,730,432 | 5/1973 | Bennett . | |
| 3,791,102 | 2/1974 | Huntington | 261/20 |
| 3,802,624 | 4/1974 | Kuhne et al. . | |
| 3,804,328 | 4/1974 | Lane et al. . | |
| 3,851,822 | 12/1974 | Pocrnja et al. | 239/2.1 |
| 3,899,129 | 8/1975 | Fukuta et al. . | |
| 4,600,147 | 7/1986 | Fukuta et al. . | |
| 4,653,690 | 3/1987 | St. Amand et al. . | |
| 4,726,517 | 2/1988 | Boguslawski | 239/14.1 |

FOREIGN PATENT DOCUMENTS

| | | | |
|---|---|---|---|
| 2016863 | 10/1971 | Fed. Rep. of Germany | 239/2.1 |

OTHER PUBLICATIONS

Chemical Engineers Handbook, Third Edition, John H. Perry PHD, McGraw-Hill Book Co, Inc. (1950) pp. 177-180.

*Primary Examiner*—Andres Kashnikow
*Assistant Examiner*—Lesley D. Morris
*Attorney, Agent, or Firm*—Rosenblatt & Associates

[57] ABSTRACT

Fog is dispelled from a site by passing fog-laden air into a drying unit where it is contacted with a dessicant liquid (either an aqueous solution or a deliquescent absorbent which is not calcium chloride or a liquid dessicant such as glycerol or certain others) under conditions which effectuate absorption of the water particles and some water from the air effective to increase the temperature of the air and dry it to a predetermined relative humidity range, then discharging the dried heated air from the unit into fog-laden air at the site to effectuate vaporization of suspended water particles and associated cooling of the discharged air without development of thermals of the discharged air sufficient to create substantial circulation of fog-laden air into the site.

20 Claims, 2 Drawing Sheets

METHOD AND APPARATUS FOR DISPELLING FOG

This is a continuation of copending application Ser. No. 07/508,906 filed on Apr. 12, 1990 now abandoned.

BACKGROUND OF THE INVENTION

1. Field of the Invention

This invention relates to processes of weather control or modification, and more particularly, to methods and apparatus for dispelling fog.

2. Description of Related Art

There is a need for a method of dispelling fog at definable sites, such as airports or racetracks, in order that events such as flight arrivals and departures at airports or racing programs at race tracks can occur as scheduled. Although there has been substantial effort directed to meeting this need, the methods that have been developed still have not sufficed, for reasons including environmental pollution and cost.

Fog is a weather condition in which moisture particles are suspended in saturated air near the ground at levels of between 0.1 and 0.5 grams per cubic meter. Control or dispersement of that fog requires the evaporation or removal of these suspended particles. Various fog-dissipation methods have been tried in the past.

Heating fog-laden air evaporates the suspended water particles by increasing the air temperature, adding heat of vaporization, and increasing the amount of moisture that the air can hold. This process creates thermals of warm air which rise from the site, circulating cool, fog-laden air into the site. Heating air to dissipate fog was used during World War II in Great Britain when airplane engines were run along the runway. Barrels of burning fuel oil were also used along runways to add heat to the air and evaporate the suspended water particles. Both of these concepts added air pollutants, had high operating costs, and did not accomplish the desired result unless operated continuously.

Helicopter downwash has been applied to clear fogs and clouds with small scale success, but it has not proved practical for large-scale operations.

Subcooling the air removes suspended liquid and vapor by cooling and collecting the moisture in suspension, dropping the air temperature, and condensing moisture vapor from the air. Air is subcooled using a mechanical cooling system which circulates a cold liquid through a coil. Both the latent and sensible heat are removed from the air as it is circulated over the coil. After the moisture and sensible heat have been removed, the cooled dried air is reheated to the surrounding temperature so that it may absorb the suspended moisture from the wet air in the discharge area of the fan system. This process is expensive due to the mechanical removal of both sensible and latent heat and the addition of sensible heat back to the air. Large quantities of high-cost, limitedsupply electricity are used in this process. The initial cost and maintenance costs are also high.

Hydroscopic particles can be seeded from aircraft to evaporate fog droplets and drop the resultant dilute solution droplets to the ground. This method has been tested in many places in the world with small-scale success, but since the material is thrown away every time, the cost is high and environmental pollution becomes severe. . Examples of U.S. Patents involving use of chemicals to dispel fog include U.S. Pat. Nos. 2,934,275; 3,274,035; 3,378,201; 3,434,661; 3,608,810; 3,608,820; 3,730,432; 3,802,624; 3,889,129; 4,600,147; and 4,653,690. U.S. Pat. No. 2,934,275 discloses a process of dispelling fog by forming a mixture of an aqueous solution of chloride salts of calcium, magnesium or zinc with thickening agents of starches, sugars or proteins into a mist having particles smaller than ½ mm in diameter; forming a normally liquid chlorinated aliphatic hydrocarbon into a mist having particles smaller than ½ mm in diameter; and commingling the mist with the fog to be treated. Calcium chloride is a chemical desiccant. Chemical desiccants act as defoliates and are environmentally harmful to plant life, in practical effect prohibiting their utility as an airborne treatment.

Desiccants have been used to dry natural and manufactured gases and for air conditioning purposes; for example, see the Chemical Engineers Handbook, Third Edition, John H. Perry, Ph.D., Ed., McGraw-Hill Book Co., Inc., at topic "Drying of Gases," pp. 877–880.

SUMMARY OF THE INVENTION

In accordance with this invention, a method is proved for dispelling fog from a site such as an airport. Fog-laden air containing suspended water particles at the site is moved into a chamber or housing through an inlet to the chamber and in the chamber is passed into contact with a desiccant liquid under conditions effective for the desiccant liquid to absorb the suspended water particles from the fog-laden air and increase the temperature of the air a controlled extent so that the air is heated and dried to a predetermined relative humidity range. The heated dried air is then discharged from the chamber through at least one outlet into fog-laden air at the site under conditions effective to vaporize the suspended water particles in that fog and cool the discharged air without the development of thermals of rising discharged air that are sufficient to create substantial circulation of fog-laden air from outside the site into the site.

The concentration and temperature of the desiccant liquid and the volume of flow of air through the chamber is controlled to regulate the dryness and temperature of the discharged air to the predetermined relative humidity range.

The chamber may include a plurality of ducts associated with the chamber outlet, each duct having at least one outlet and being organized for distribution of dried air at the site where fog is to be dispelled. By controlling one or more of the (i) concentration and (ii) temperature of the desiccant liquid, the (iii) flow volume of air through the chamber, and the (iv) distribution of dried air through the ducts, vaporization of suspended water particles and cooling of the discharged air is essentially horizontally effectuated to dispel site fog in horizontal strata without development of thermals of rising discharge air sufficient to create substantial circulation of fog-laden air from outside the site into the site. Substantial circulation occurs when the discharge of the drying unit vertically ascends through the surrounding air to such an extent that it induces an influx of cooler heavier fog-laden air from outside the site equal to the discharge flow of the drying unit.

The term "desiccant liquid" as employed herein means a desiccant liquid selected from a first group of, (a) an aqueous solution of a soluble deliquescent absorbent except calcium chloride, or from a second group of (b) a liquid desiccant from the group consisting of sulfuric acid, phosphoric acid, glycerol, and the ethylene glycols, including diethylene and triethylene glycol. Suitable deliquescent absorbents other than calcium chloride include sulfates of sodium, calcium, and magnesium, potassium carbonate, calcium oxide, zinc bromide, zinc chloride, and alkali earth metal hydroxides, such as sodium hydroxide or potassium hydroxide. Selection will be made according to cost of materials and the ability to handle corrosive or toxic liquids or solutions.

According to the scope of the drying requirements of a particular site and the desiccant liquid and conditions employed, the manner of contacting the desiccant liquid with the fog-laden air suitably may be by sprays or tower packings to ensure large surface exposure and low pressure drop.

Apparatus for dispelling the site fog preferably comprises a chamber having a inlet or outlet and a filter media disposed in the chamber between the inlet and outlet. Sprayers are operatively associated with the chamber for spraying desiccants liquid onto the filter media, the provision is made for collecting desiccant liquid draining from the media and recirculating it back over the media. An air mover, such as a large-volume, low-static fan, is operatively associated with the chamber to move the fog-laden air into the chamber, through the media, ant out the chamber outlet as dried discharged air. Ducting, preferably inflatable, is arranged with the outlet of the chamber for distributing the dried air according to the needs of the site. In the usual application, the apparatus will include a reservoir for the desiccant liquid within the circulation circuit. In smaller applications, suitably the desiccant liquid that drains down from the media and is collected in the base of the chamber is recirculated over the media until it absorbs approximately its weight in water. The dilute desiccant liquid may be then pumped from the reservoir and replaced with a concentrated desiccant liquid. Particularly where site conditions call for plurality of treatment units, the replacement process may use transport of the desiccant liquid to and from a central concentrator system. Suitable transport may be lined or fiberglass tank trucks or a piping system. Liquid volume may be monitored to determine when the desiccant liquid should be changed.

The recirculation liquid may be heated at a central concentrator to reduce the dilution of the liquid resulting from removal of moisture from the fog-laden air by the desiccant liquid.

In large-scale permanent installations, the central concentrator may be included in the desiccant liquid recirculation circuit, and after-coolers for cooling the recirculation liquid to a temperature within a predetermined range at or slightly above the temperature of the fog-laden air may be provided in the recirculation circuit after the liquid is heated and before the liquid is recirculated onto the media.

In accordance with this invention, about 0.1 to 0.5 gram per cubic meter of suspended particulate moisture and about 5 grams per cubic meter of moisture vapor is condensed and absorbed by the desiccant liquid. Temperature elevation of the treated air results from the heat of vaporization given up by the moisture-laden air as the moisture condenses and is absorbed. The heat of the discharged dry air evaporates suspended water particles in the foggy air at the site, removing heat of vaporization from the discharged air and cooling it to surrounding site temperatures. Each cubic meter of foggy air that passes through the system and is dried is effective to vaporize suspended water particles in and thereby clear about 50 cubic meters of foggy air at the site.

At a barometric pressure of about 101.325 $kP_a$, and at a temperature of about 10° C., fog-laden air or air in a foggy condition contains about 9.5 to about 9.9 grams per cubic meter of water, of which about 0.1 to 0.5 grams per cubic meter is water in excess of saturation capacity of the air at that temperature and pressure. At these conditions air dried and discharged from the treating unit in accordance with this invention will have a water content of about 4.4 grams per cubic meter and a relative humidity near 50%, about 47%. At about the same barometric pressure and at a temperature of 20° C., the saturation capacity of air is about 17.3 grams per cubic meter, and after removal of 0.1 to 0.5 grams per cubic meter of suspended particulate water and about 5 grams per cubic meter of water vapor, the dried air discharged from a treating unit has a water content of about 12.3 grams per cubic meter and a relative humidity of 71%.

If, for example, the volume of air to be cleared is one hundred million cubic meters and has a suspended particulate moisture of 0.1 grams per cubic meter of fog, about 10 tons of suspended particulate moisture must be evaporated to clear the fog. At least an equal tonnage of the desiccant liquid is required, and with a conventional safety factor of 4, preferably 40 tons of desiccant liquid is employed in the process.

DETAILED DESCRIPTION OF THE PREFERRED EMBODIMENT

Figure 1:
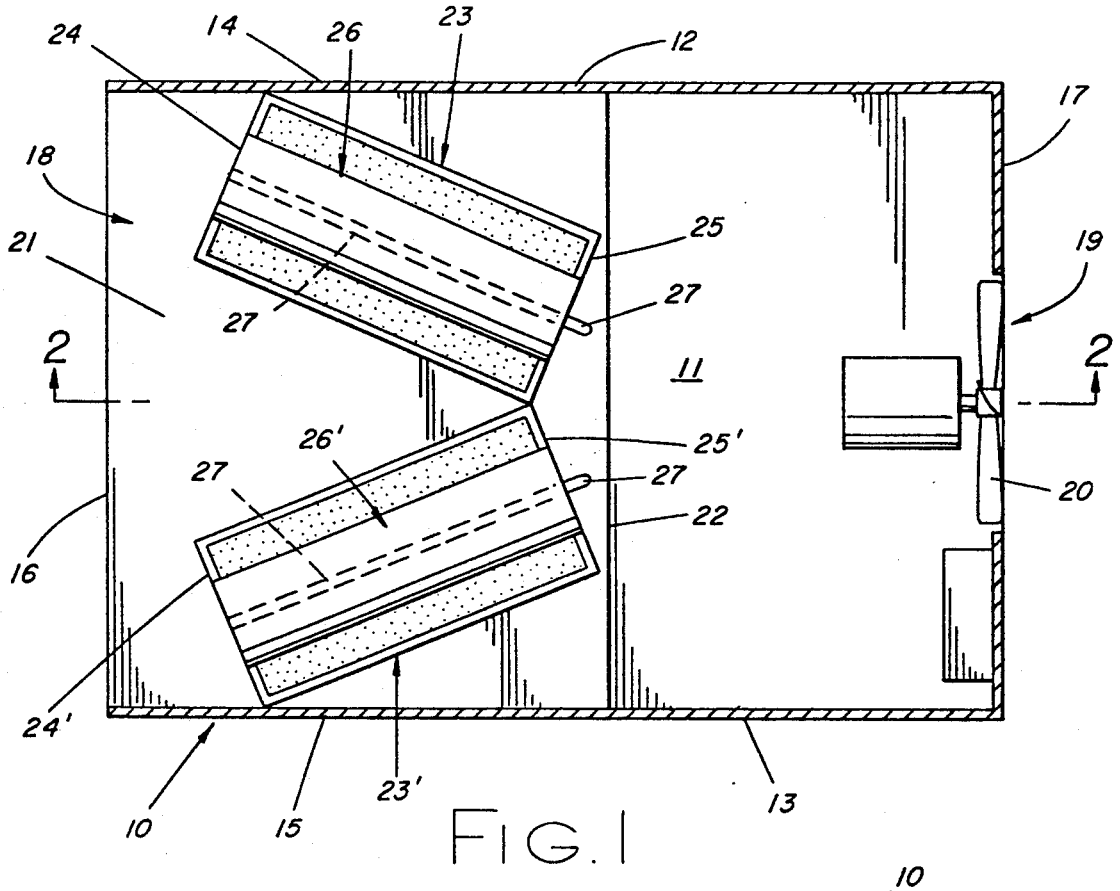
FIG. 1 is a plan view of a drying unit used for treating fog in accordance with this invention.
Figure 2:
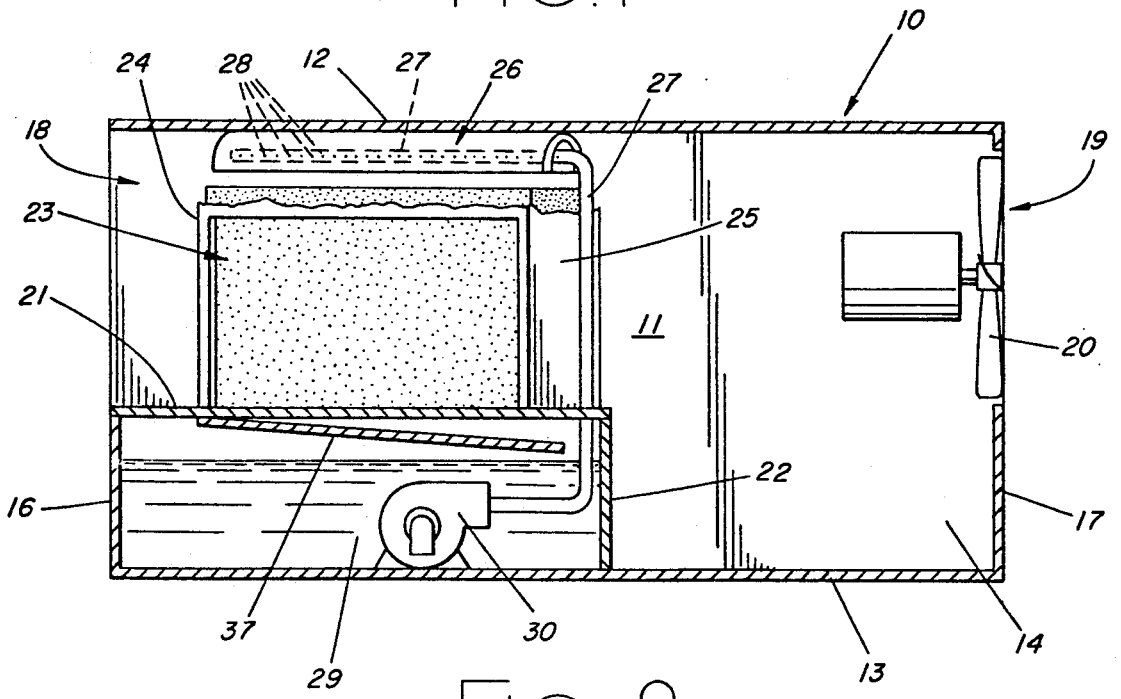
FIG. 2 is a side elevational view of the unit shown in FIG. 1.

Referring to FIGS. 1 and 2, a device generally indicated by reference numeral 10 and constructed to dispel fog in accordance with this invention is schematically illustrated. The unit includes a chamber 11 consisting of a top panel 12, bottom panel 13, side panels 14 and 15, and end panels 16 and 17. End panel 16 does not close the chamber in a major area below top 12, defining an opening or inlet 18. End panel 17 does not close the chamber in a major area below top 12, defining an opening or outlet 19. A large-volume, low-static fan 20 is mounted for rotation in outlet 19 within a fan shroud (not illustrated). Mounted horizontally between side panels 14 and 15 at the upper margin of end 16 (lower margin of inlet 18) is a perforated horizontal support member 21. Mounted vertically between side panels 14 and 15 and joining the horizontal support 21 remote from inlet 18 is a vertical partition 22.

Interposed between the inlet 18 and outlet 19 upon a perforated horizontal support 21 is a filter media which includes two identical filter structures 23 and 23'. Filter media 23, 23' are angled away from each other at their narrow ends 24 and 24' nearest inlet 18, so one corner of each of ends 24 and 24' adjoins the sides 14 and 15 of chamber 11 for the full depth of the filter media 23 and 23'. Filter media 23 and 23' are joined at their other narrow ends 25 and 25', remote from inlet 18. This orientation maximizes the surface area facing foggy air admitted by inlet 18 and requires all admitted air to pass through the filter media 23 and 23' to reach outlet 19.

Supported above filter media 23 and 23' are sprayers 26 and 26' comprising tubing 27 provided with numerous apertures 28 along the tubing length through which liquid in the tubing is sprayed down upon the media to thoroughly wet the media through its full extent with desiccant liquid and provide a high surface area of desiccant liquid for contact with foggy air admitted by inlet 18. Below perforated horizontal support 21, a collector 37 flows desiccant liquid draining from media 23 and 23' into the reservoir 29 defined by end 16, sides 14 and 15, vertical partition 22, and bottom panel 13. A pump 30 recirculates liquid from reservoir 29 to sprayers 26 and 26' and provides spray pressure. The pump 30 and motor for fan 20 are powered by an energy source (not illustrated).

In the operation of device 10, reservoir 29 is charged with a desiccant liquid, and pump 30 is engaged to circulate liquid through tubing 27 to sprayers 26 and 26' onto filter media 23 and 23' to thoroughly wet the filter media through their entire extent. Fan 20 is then energized. Fog-laden air at the site of chamber 11 is moved by the draw of the fan into unit 10 through inlet 18, and under the further draw of the fan is passed in contact across the filter media 23 and 23' wetted with the desiccant liquid for absorption of the water particles and an effective amount of the water vapor from the fog-laden air to increase the temperature of the air a controlled extent, thereby heating and drying the air to a predetermined relative humidity range. Desiccant liquid draining from media 23 and 23' is collected by collector 37 and flowed into reservoir 29, where pump 30 recirculates it back through tubing 27 and out sprayers 26 and 26' onto the media. The dried air heated by the heat of vaporization received from the water vapor is then discharged from chamber 11 through outlet 19 under the influence of fan 20.

Figure 3:
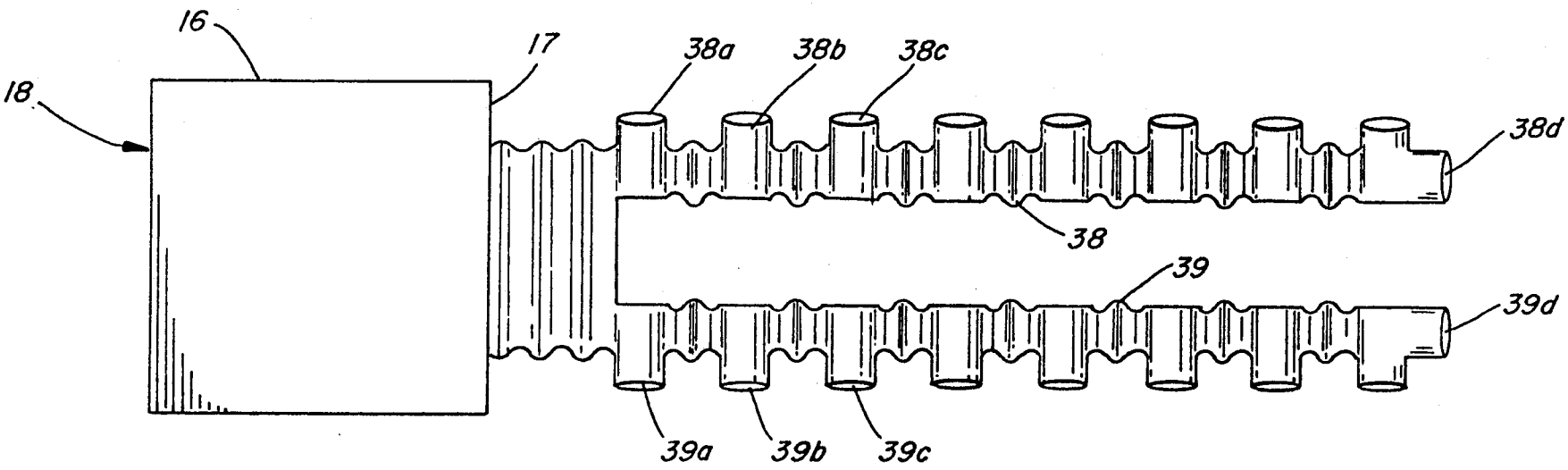
FIG. 3 is a schematic view illustrating ducting leading from the unit of FIG. 1.

Referring to FIG. 3, the heated, dried fog-free air from unit 10 is distributed at the site of foggy air by ducting suitably comprising a plurality of ducts 38 and 39, each with outlets 38*a*, 38*b*, 38*c*, 38*d* for duct 38, and outlets 39*a*, 39*b*, 39*c*, 39*d* for duct 39.

Having now described my invention, various modifications within the spirit and scope of the invention, as defined by the following claims, will be apparent to those skilled in the art.

I claim:

1. Apparatus for dispelling fog from a site, which comprises a chamber having an inlet and outlet, a media disposed in the chamber between the inlet and outlet providing surface for contact of fog-laden air with a desiccant liquid, means operatively associated with said chamber for distributing a desiccant liquid onto said media, and means operatively associated with said chamber for moving fog-laden air into said chamber through said media and out said chamber outlet as dried discharge air.

2. The apparatus of claim 1, further comprising means operatively associated with said chamber for collecting desiccant liquid draining from said media.

3. The apparatus of claim 2, further comprising means for recirculating said collected desiccant liquid to said distributing means.

4. The apparatus of claim 3, further comprising means for heating said recirculation liquid to reduce dilution of said liquid resulting from removal of moisture in fog-laden air by said desiccant liquid.

5. The apparatus of claim 4, further including means for cooling said recirculating liquid to a temperature within a predetermined range at or slightly above the temperature of the fog-laden air after heating of the liquid by said heating means and before recirculation onto said media.

6. The apparatus of claim 2, in which said collecting means further includes a reservoir for said desiccant liquid, and further comprising means for recirculating said collected desiccant liquid to said distributing means.

7. The apparatus of claim 6, further including means for heating and recirculation liquid to reduce dilution of said liquid resulting from removal of moisture in fog-laden air by said desiccant liquid.

8. The apparatus of claim 7, further including means for cooling said recirculating liquid to a temperature within a predetermined range at or slightly above the temperature of the fog-laden air after heating of the liquid by said heating means and before recirculation onto said media.

9. The apparatus of claim 1, further comprising ducting means operatively associated with said outlet for distributing said dried air at said site.

10. The apparatus of claim 9, wherein said ducting means are inflatable.

11. The apparatus of claim 1, in which said means for moving air comprises a large volume, low static fan.

12. A method of clearing foggy air, which comprises:

providing (i) a chamber having an inlet and an outlet, and (ii) a media across said chamber between said inlet and outlet providing surface for contact of fog-laden air with a desiccant liquid, distributing a desiccant liquid having a temperature not cooler than said foggy air onto said media from gravity flow down said media, moving said foggy air into said chamber from said inlet and through said media for intimate contact with said desiccant liquid on said media whereby particulate water and some water vapor is absorbed from said foggy air, thereby drying the air and releasing heat of absorption to said air raising the temperature of such air, and moving heated, dried, fog-free air from said media through said outlet.

13. The apparatus of claim 12, further comprising collecting desiccant liquid draining from said media and recirculating it from distribution onto said media.

14. The apparatus of claim 13, further comprising heating the collected desiccant liquid to evaporate water therefrom and to concentrate the desiccant liquid, before distributing the desiccant liquid onto said media.

15. The apparatus of claim 14, further comprising cooling said desiccant liquid to a temperature approximating the temperature of the foggy air moved into said chamber, said cooling step occurring after said heating step and before said distributing step.

16. The method of claim 12, in which said desiccant liquid is a soluble deliquescent absorbent in aqueous solution.

17. The method of claim 12, in which said desiccant liquid is a liquid selected from the group consisting of sulfuric acid, phosphoric acid, glycerol and ethylene glycols.

18. The apparatus of claim 12, further comprising distributing said dried air at a site of foggy air.

19. A method for clearing foggy air having a temperature in the range from about 10° C. to about 20° C. and containing from about 0.1 to about 0.5 grams per cubic meter of particulate moisture, which comprises:

providing (i) an elongate chamber having an inlet and an outlet and (ii) a media across the elongate direction of said chamber between said inlet and outlet providing surface for contact of fog-laden air with a desiccant liquid, distributing a desiccant liquid having a temperature approximately and not cooler than the temperature of said foggy air, onto said media for gravity movement down said media, moving foggy air into said chamber from said inlet and through said media for intimate contact with said desiccant liquid on said media, whereby from about 5.1 to about 5.5 grams per cubic meter of particulate and vapor moisture is removed from the fog-laden air by absorption, thereby releasing heat of absorption to said air raising the temperature of said air about 5° C., and moving heated, dried, fog-free air from said media through said outlet.

20. The method of claim 19 in which the relative humidity of the heated, dried, fog-free air is in the range from about 47% to about 71%.

* * * * *